United States Patent [19]

Jaicks

[11] Patent Number: 4,558,796

[45] Date of Patent: Dec. 17, 1985

[54] ANIMAL PROOF STORAGE CONTAINER APPARATUS

[76] Inventor: John R. Jaicks, 40 Harvest Dr., Scarsdale, N.Y. 10583

[21] Appl. No.: 535,655

[22] Filed: Sep. 26, 1983

[51] Int. Cl.[4] ..... B65F 1/16; B65D 25/28; B65D 41/04

[52] U.S. Cl. ..... 220/1 T; 220/94 R; 220/288

[58] Field of Search ..... 220/1 T, 288, 94 R

[56] References Cited

U.S. PATENT DOCUMENTS

| | | | |
|---|---|---|---|
| 76,229 | 3/1868 | Miller | 220/288 |
| 674,530 | 5/1901 | Wilcox | 220/288 |
| 1,037,625 | 9/1912 | Hofer | 220/1 T |
| 1,286,368 | 12/1918 | Lucas | 220/20.5 |
| 1,683,823 | 9/1928 | Heil | 220/288 |
| 1,961,298 | 6/1934 | Lundy | 220/288 |

FOREIGN PATENT DOCUMENTS

| | | | |
|---|---|---|---|
| 19832 | 12/1980 | European Pat. Off. | 220/1 T |
| 1500504 | 7/1975 | United Kingdom. | |

*Primary Examiner*—George E. Lowrance
*Attorney, Agent, or Firm*—Lackenbach, Siegel, Marzullo, Presta & Aronson

[57] ABSTRACT

A storage container forming a compartment for storing garbage or edibles. The compartment is kept sealed from entry by a wild animal by the lid member being threadable onto the container member. A plurality of vertically extending hand grips are connected to the lid member at angular intervals. A plurality of hold down flange members are connected to the bottom of the container at angular intervals so that a user can hold the container member against the support surface with one or both feet while threading the lid onto or from the container member.

12 Claims, 7 Drawing Figures

FIG. 2
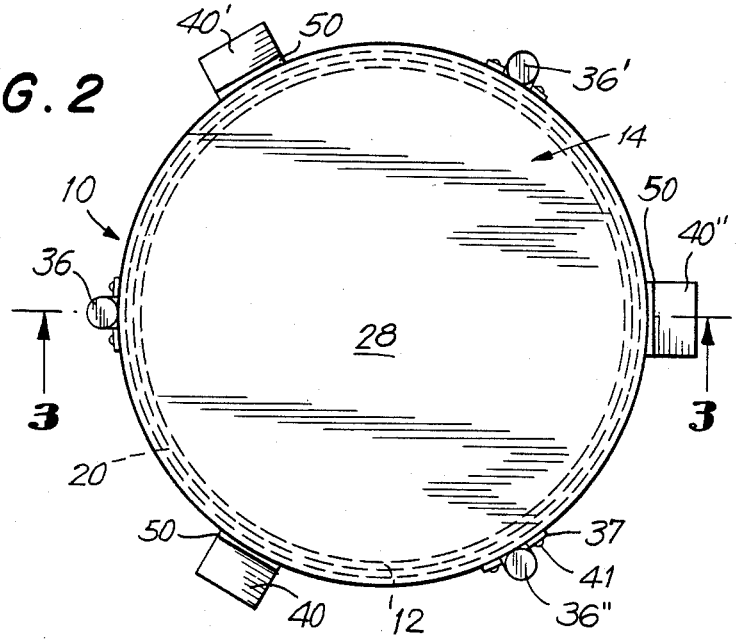
FIG. 1
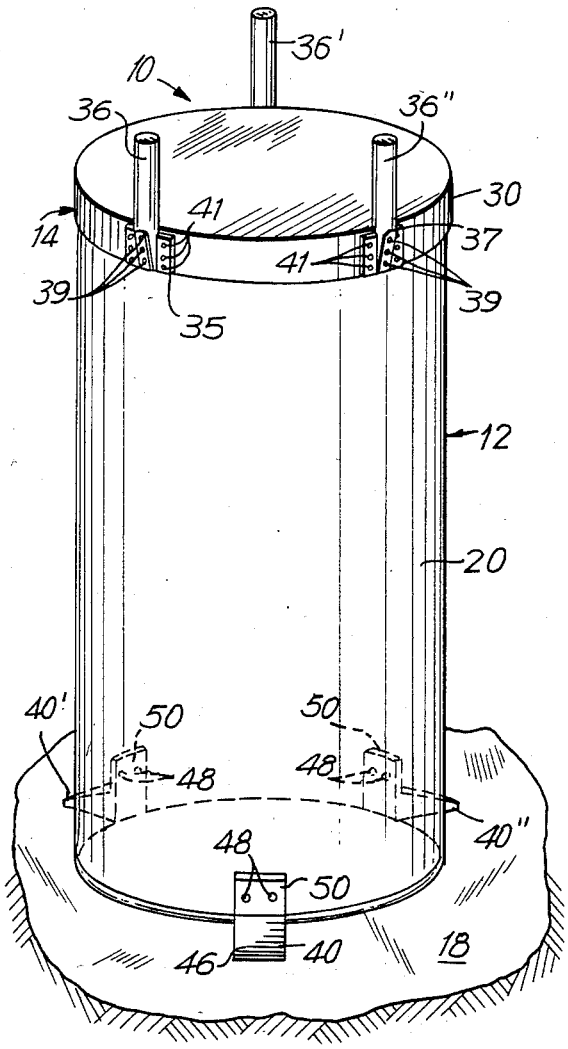
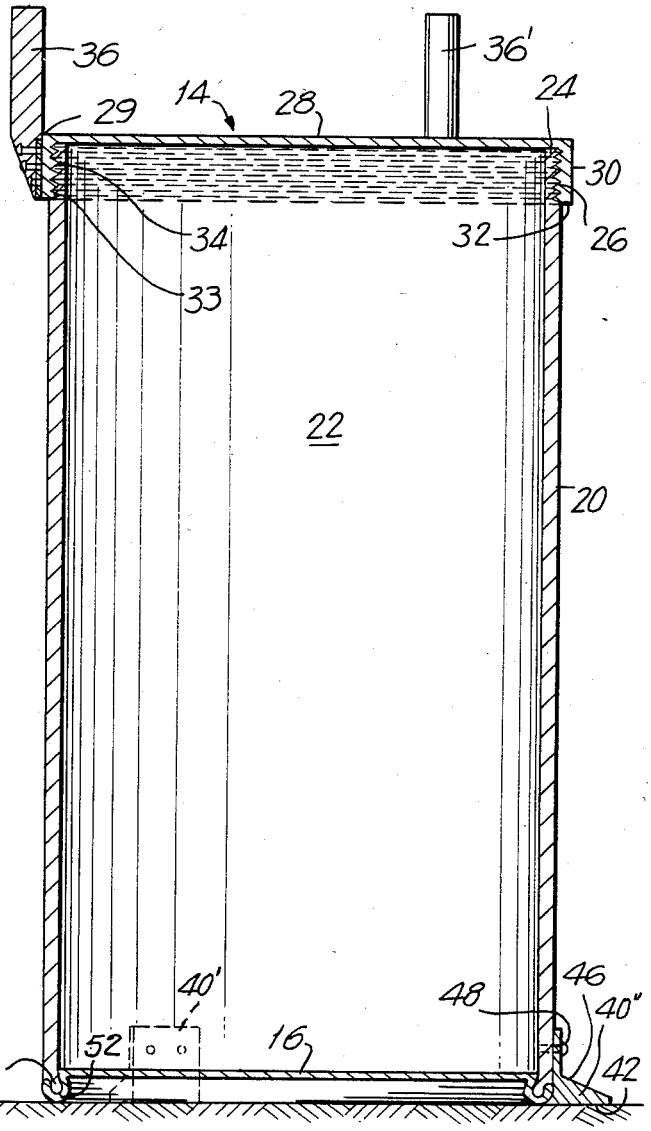
FIG. 3

ANIMAL PROOF STORAGE CONTAINER APPARATUS

BACKGROUND OF THE INVENTION

This invention relates generally to protecting the contents of a storage container such as a garbage container from relatively large wild or domestic animals. The type of storage container generally contemplates here is that of what is commonly known as a garbage can and is approximately 2 to 2½ feet in diameter and approximately 2½ to 3 feet in height. The storage capacity is approximately 25–35 gallons for a conventional garbage can.

It is known that animals, more commonly wild animals, such as raccoons, bears, coyotes, and the like in search of food, are ingenious and cunning at gaining access to storage containers that hold edibles. One common case in point is the raccoon of suburban communities throughout the United States that are adept at removing the lids of garbage containers at night and pulling out and strewing around the contents of the container. In the morning, the people living in the house find the garbage that was neatly packed away the night before thrown about the area of the container. These occurrences are repeated by other animals, such as bears and coyotes, that tend to enter more remote human habitational areas in certain parts of the country at night in search of food.

Yet there seems to be no available system of preventing these animals from entering the containers, except for systems that most people would not want to bother with. In general, people simply want to place the family garbage in a container with traditional lids, rather than resort to a complex prevention system . It is to be noted that garbage containers especially are usually set out for pick up and then are brought back to a garbage storage site subsequent to pick up, a process that calls for garbage containers not burdened with a complex locking system.

Some of the systems presently employed for preventing animals from getting into garbage containers involve the use of tie down straps and hooks or springs. The device employing springs requires their providing tension when in use so as to tightly keep the cover or lid on the container. As a result thereof, the springs, when in use, can easily hurt people as sometimes they can be inadvertently disconnected and could fly off or snap and easily whip lash around and cause injury to either the homeowner or a sanitation man. In fact, most sanitation men do not like such tie down devices because they physically maintain the lid attached to the container. In so doing, the lid is an obstruction and makes it difficult for the pail to be emptied.

Moreover, these tie down devices and other spring gadgets are expensive and must be frequently replaced, as they are easily broken, particularly by the sanitation men who usually handle the covers and lids in a rough manner, and prefer not to have the lid or cover physically restrained in place to the container itself. With the storage container of the present invention, the sanitation men would have no difficulty in emptying the container as the lid is completely removed and is not restrained and held against the container when the lid is unthreaded. Easily operated systems for preventing animals from entering a storage container are not generally available for containers other than garbage containers. Often food at a campsite, for example, cannot be left in a simple container with a lid, for a large animal can easily remove the lid and rummage through the container.

A number of patents have been issued by the United States Patent Office that relate generally to refuse containers having handles attached or having elongated members acting between the face of the closure and opposed abutments of the walls of the container.

One such patent is U.S. Pat. No. 550,183 issued Nov. 19, 1895 to J. Leembruggen that discloses a receptacle for food having a pair of slanted outwardly curved grooves 5,5* formed in the circular wall of the receptacle. Grooves 5, 5* are adapted to receive the ends of a hold down device comprising a spring 6, the middle portion of which is bent to a concave form and is arranged to press upon the top of cover 3 and to force the rim 4 thereof toward the shoulder 2. The spring lock is not particularly advantageous as a discouragement to wild animals, who would most likely worry away the spring from the grooves.

Another patent is U.S. Pat. No. 2,279,991 issued Apr. 14, 1942 to J. K. Hotchkiss that discloses a jar closure having slots formed by strands 12 into which are snugly received the lugs 8 of the jar A upon a requisite turning movement of the member R. This invention again, if applied to a garbage container, would be unlikely to prove an obstacle for very long against the patient efforts of animals to enter the container.

Still another invention is U.S. Pat. No. 552,948 issued Jan. 14, 1896 to M. Witt that discloses a vessel and cover for removal of refuse. A centerplate i of the cover is pressed downwardly by a screw l, with the centerplate in turn is pressed upon the receptacle around a tightening-ring that bears upon a bead b around the periphery of the receptacle. The tighteningring in turn is held between a pair of cover plates h and g, with centerplate i bearing upon plate h. The described invention is comparatively elaborate and although effective for providing a seal around the mating circumference of the cover and receptacle, it is over-elaborate as far as providing a barrier to wild animals. It may also be noted that upper plate h of the cover is bulged and resiliently yields upon tightening of the top screw. Hence a metal material is required with several parts with the resulting weight factor, not mention the cost. Lightweight plastic also is an unlikely material for this invention.

Other patents of interest in this case are as follows:

| Inventor | U.S. Pat. No. | Date of Issuance |
|---|---|---|
| Gluckman | 926,864 | July 6, 1909 |
| Nylund | 1,129,222 | Feb. 23, 1915 |
| Porter | 1,728,945 | Sept. 24, 1928 |
| Hight | 1,802,551 | Apr. 28, 1931 |
| Loeber | 1,856,877 | May 3, 1932 |
| Wenger | 1,892,743 | Jan. 3, 1933 |
| Curtis | 2,111,359 | Mar. 15, 1938 |
| Urech | 2,123,126 | July 5, 1938 |
| Tiffany | 2,238,379 | Apr. 15, 1941 |
| Biddlecombe | 2,632,580 | Mar. 24, 1953 |
| Worth | 2,717,167 | Sept. 6, 1955 |
| Freser | 2,756,084 | July 24, 1956 |
| Zobel | 4,351,449 | Sept. 28, 1982 |
| McQuiston et al | 4,384,656 | May 24, 1982 |

SUMMARY OF THE INVENTION

Accordingly, it is an object of the present invention to provide a storage container that is simple to manufacture, easy to operate, and very effective against being entered by animals, and even other pests, such as insects, roaches, etc. as the full threaded means of the storage container precludes odors from escaping and also is an extremely tight connection which cannot be penetrated.

It is another object of the present invention to provide a storage container that is fool proof and cannot be opened by an animal.

It is yet another object of this invention to provide an animal proof storage container having a lid that can be manipulated by vertically extending handles so as to be threaded onto a container.

It is yet another object of this invention to provide an animal proof storage container provided with a threaded lid with vertical handles and a threaded container provided with foot flanges for holding down the container as the lid is being screwed onto the container.

Accordingly, in order to achieve the above objects, as well as others that will become apparent hereafter, an animal proof storage container apparatus is provided including a substantially rigid cylindrical container member having a circular bottom wall resting upon a support surface and an upright circular side wall secured to the bottom edge portion of the side wall, thus defining a substantially enclosed cylindrical storage compartment. The side wall has a circular top rim portion and the container member includes a container member thread portion associated with the top rim portion. The storage container apparatus also includes a substantially rigid lid member having a circular top wall having a circular edge portion. The lid member includes a lid member thread portion associated with the circular edge portion. The lid member thread portion and the container member thread portion are adapted to removably connect the lid member and the container member in threaded relationship. The storage container apparatus includes a gripping member connected to the lid member, the gripping members being adapted to provide a hand hold for a user in the process of threading or unthreading the lid member onto or from the container member. The side wall of the container member has an outer surface and the container member thread portion includes an external thread portion extending downwardly from the top rim portion. The lid member includes a short circular edge wall secured to and depending from the circular edge portion of the circular top wall. The edge wall has a circular bottom ridge portion an an inner surface. The lid member thread portion includes an internal thread portion disposed between the top wall and the bottom rim portion. The internal thread portion is adapted to receive the external thread portion of the container member.

Hand grips are connected to the top of the lid member for a user to hold while in the process of screwing or unscrewing the lid member respectively onto or from the container member. The hand grips include a plurality, preferably three, elongated substantially cylindrical handles extending upwardly from the edge portion of the top wall at substantially equal angular intervals around the edge portion of the lid member. A plurality, preferably three, of hold down flange members extend outwardly from the outer surfaces of the container member at the bottom wall. The flanges are adapted to rest against the support surface and to receive the foot of a user pressing against the top of one or two flanges so that the container member is held against the support surface while the lid member is being screwed onto or from the container member. The hold down flanges are spaced at approximately equal angular intervals around the side wall of the container member. The lid member and the container member can be made either of a lightweight metal or of a rigid plastic material. Small women and children who have a short reach can easily grip two closed hand grips for unscrewing and screwing the lid member onto the can.

The present invention will be better understood, and the objects and important features, other than those specifically enumerated above, will become apparent when consideration is given to the following details and description, which when taken in conjunction with the annexed drawings, describes, discloses, illustrates, and shows preferred embodiments or modifications of the present invention and what is presently considered and believed to be the best mode of practice in the principles thereof. Other embodiments or modifications may be suggested to those having the benefit of the teachings herein, and such other embodiments or modifications are intended to be reserved especially as they fall within the scope and spirit of the subjoined claims.

BRIEF DESCRIPTION OF THE DRAWINGS

FIG. 1 is a perspective view of the invention with the lid member secured to the container member;

FIG. 2 is a top view of the invention as made of a metal material;

FIG. 3 is a sectional view taken through line 3—3 of FIG. 2;

DESCRIPTION OF THE PREFERRED EMBODIMENTS

Figure 4:
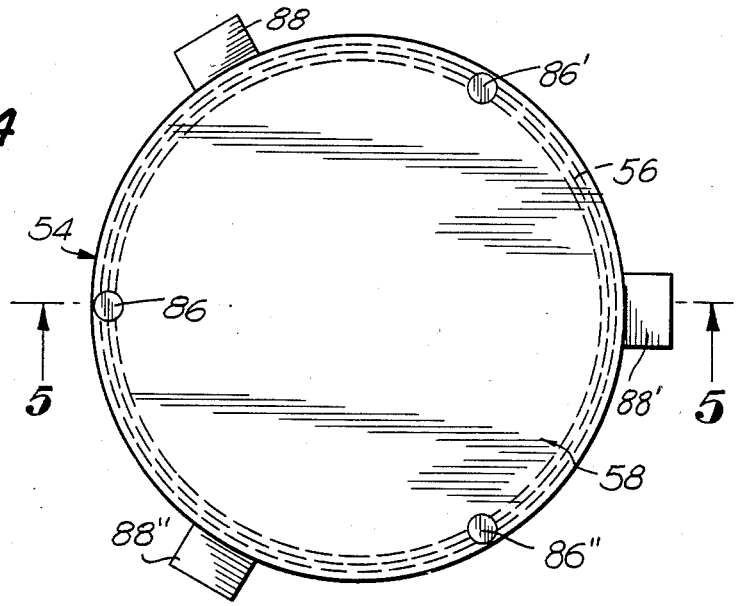
FIG. 4 is a top view of the invention as made of molded plastic material.

Reference is now made specifically to the drawings, in which identical or similar parts are designated by the same reference numerals throughout.

FIG. 1 illustrates in perspective view one embodiment of the storage container apparatus 10 including a substantially rigid cylindrical container member 12 and a substantially rigid cylindrical lid member 14. The storage container is of the general size of what is com monly known as a garbage can and is approximately 2 to 2½ feet in diameter and approximately 2½ to 3 feet in height. The embodiment shown in FIG. 1 and in FIGS. 2 and 3 illustrates a storage container apparatus 10 that is made of a lightweight metal. As shown in FIGS. 2 and 3, container member 10 has a substantially horizontal circular bottom wall 16 that rests upon a flat support surface 18 such as a floor or the ground. Container member 12 also includes an upright, or substantially vertical, side all 20 that is secured at its bottom rim portion 21 to bottom wall 16. Bottom wall 16 and side wall 20 define a generally cylindrical compartment 22 for containing edible substances such as garbage that would be an attraction for wild animals. Compartment 22 has an approximate capacity of 25–35 gallons. Compartment 22 has a substantially horizontal open face defined by the circular top rim portion 24 of circular side wall 20. The outer surface 25 of side wall 20 forms an external thread portion 26 that extends downwardly from top rim portion 24. Thread portion 26 will be discussed further below.

As also shown in FIGS. 1, 2, and 3, lid member 14 has a circular top wall 28 and a short circular edge wall 30 formed in a piece with the circular edge portion 29 of top wall 28. Circular edge wall 30 has a circular bottom rim portion 32. Edge wall 30 depends vertically from circular edge portion 29 of top wall 28. The inner surface 33 of edge wall 30 forms an internal thread portion 34 between top edge portion 29 and bottom rim portion 32 that is adapted to mate with external thread portion 26 of container member 12. FIG. 3 indicates three fully circumferential, mating threads of external and internal thread portions 26 and 34. It is noted that at least one full set of mating threads should be formed, and alternatively two, three or more full mating threads be formed. When internal thread portion 34 of lid member 14 has been threaded onto external thread portion 26 of container member 12, edge wall 30 of lid member 14 fits closely around side wall 26, lid member 14 and container member 12 have been disengageably connected, and compartment 22 has been made secure against entry by animals.

As also can be seen in FIGS. 1, 2 and 3, three hand grips 36, 36' and 36'' are connected to the circular outside surface 38 of edge wall 30. Hand grips 36,36', and 36'' are each an elongated cylindrical handle, preferably of a lightweight metal, that extends substantially vertically to a distance that allows a good hand grip for a user. The diameter of each hand grip likewise is such that it gives a user a good hand grip. The hand grips 36, 36', and 36'' are circumferentially spaced at substantially equal angular intervals around edge portion 29. In particular as shown in FIGS. 1 and 2, the angular intervals are approximately 120°. This spacing allows a user to utilize both hands to screw or unscrew lid member 14 onto or from container member 12. As can be seen most clearly in FIG. 1, each hand grip 36, 36', and 36'' has a bottom connecting portion that is riveted onto a curved metal plate 37 by rivets 39. Plate 37 in turn is riveted onto edge wall two sets of vertically aligned rivets 41 positioned on opposite sides of each hand grip. Other suitable methods of receiving hand grips 36,36' and 36'' to lid member 14 are possible.

As also seen in FIGS. 1, 2 and 3, three hold down flange members 40, 40' and 40'' are secured to outer surface 25 of side wall 20 of container member 12 at bottom wall 16. Each hold down flange member 40, 40' and 40'' extends radially outwardly from side wall 20. The bottom surface 42 of each flange member is flat and positioned against horizontal support surface 18, which can be a floor or the ground, for example. Each flange member preferably has a flat downwardly sloped top surface 46 that is spaced slightly above bottom surface 42 at side wall 20 and is approximately adjacent to support surface 18 at the outer extremity of each flange member spaced from side wall 20. It is, of course, possible within the scope and spirit of the invention to have a horizontal top wall of each flange member that is substantially parallel to support surface 42. A pair of rivets 48 pass horizontally through a curved, vertical fastening piece 50 that is connected to each flange member 40, 40' and 40'' at side wall 20. As can be seen in FIG. 3, a circular base 52 that is approximately hemispherical in cross-section extends downwardly from bottom wall 16 below side wall 20; base 52 spaces bottom wall 16 from support surface 18. Bottom surface 42 of flange members 40, 40', and 40'' extends outwardly from the bottom most area of base 52. Flange members 40, 40' and 40'' are circumferentially spaced about side wall 20 at substantially equal angular intervals. In the embodiment shown in FIGS. 1, 2 and 3, flange members 40, 40' and 40'' are spaced at approximately 120° intervals. Hold down flange members 40, 40', and 40'' provide a foot press for a user to keep container member 12 stationary against support surface 44 while lid member 14 is being screwed onto or from the container member. Also, the flange members may comprise a single circumferential flange which either alone or together with the bottom of the container member 12 has a roughened surface which provides sufficient frictional resistance to overcome twist of the container as the lid is screwed on the weight of the container and its contents assist in increasing the frictional resistance so that even a thin child without too much strength can, even with a single foot on the flange member, lock the threaded cap tightly to the container.

Figure 5:
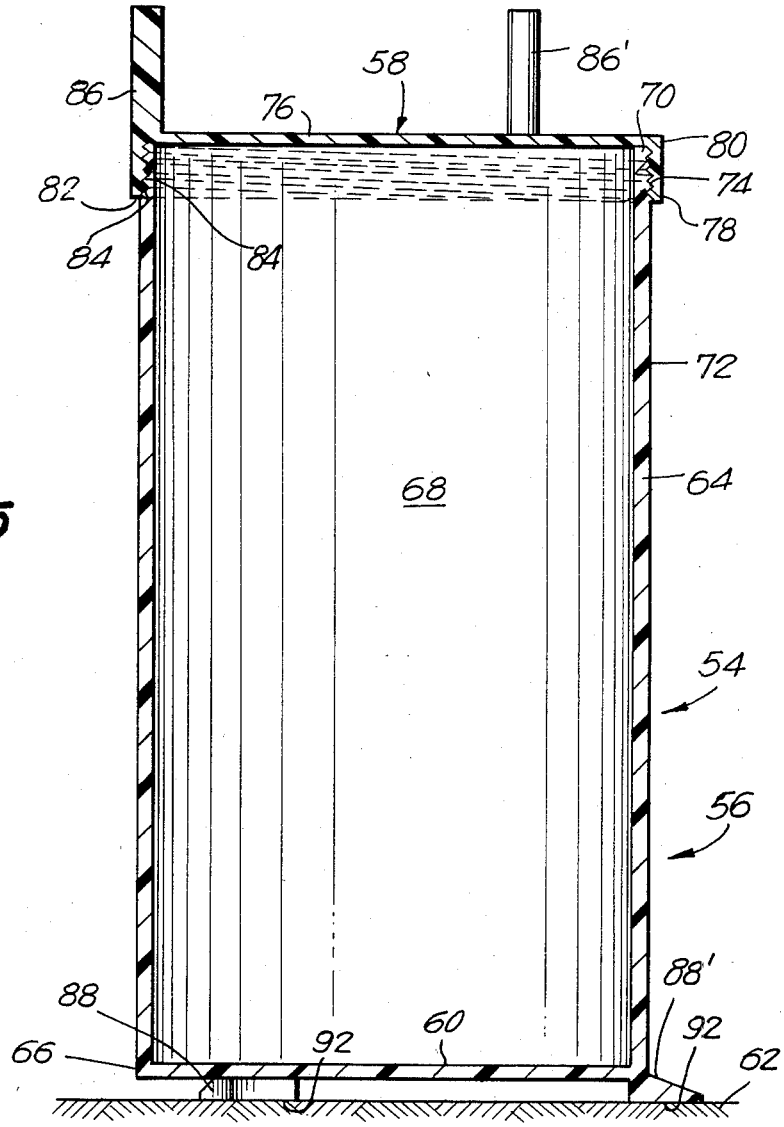
FIG. 5 is a sectional view taken through line 5-5 of FIG. 4.
Figure 4:
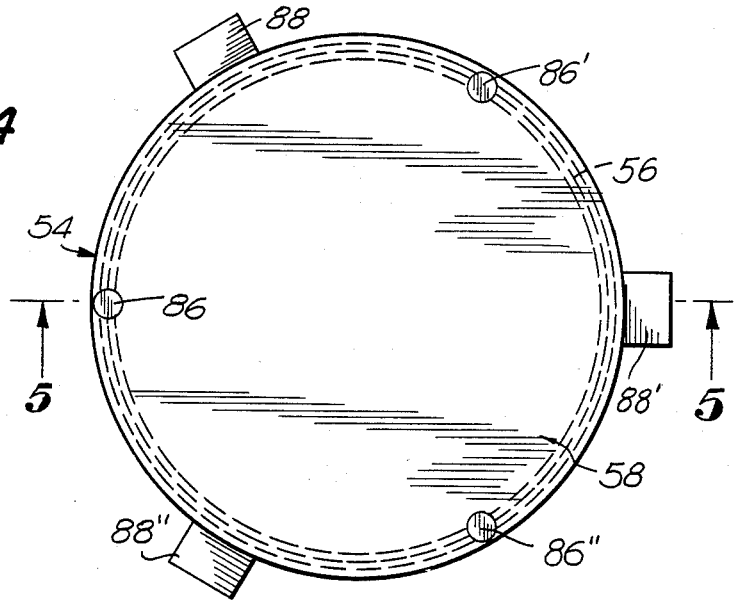
Figure 5:
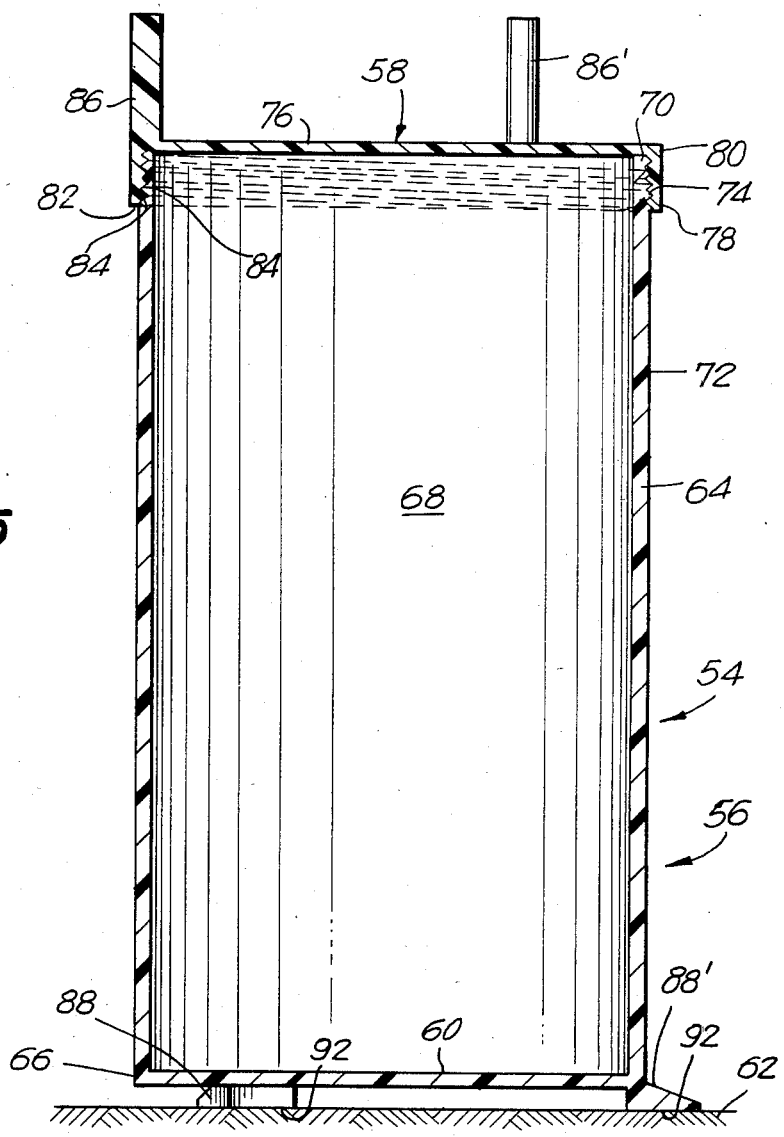
Figure 6:
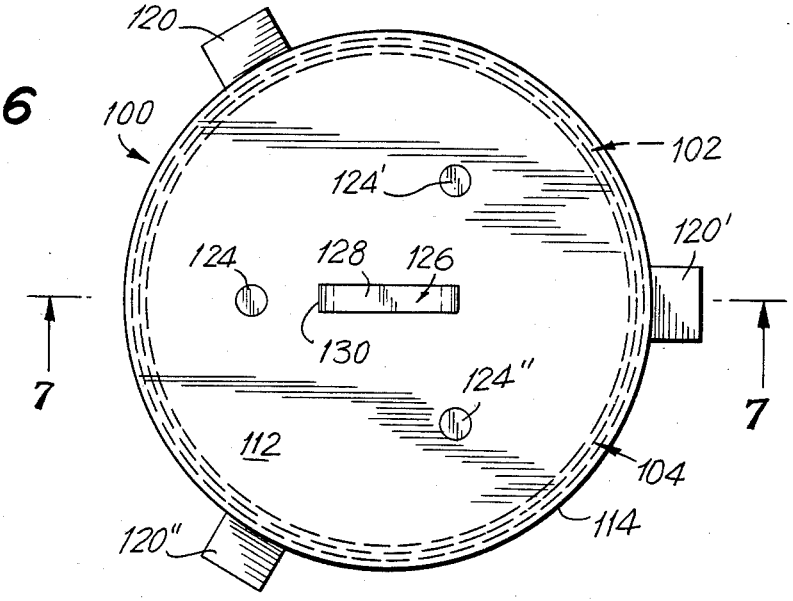
FIG. 6 is a top view of another embodiment of the invention.

Another embodiment of the present invention is shown in FIGS. 5 and 6. Here, a storage container apparatus 54 made of a substantially lightweight plastic material is illustrated, including a substantially cylindrical container member 56 and a substantially cylindrical lid member 58. Container member 56 and lid member 58 are preferably each molded in one piece. Container member 12 has a substantially horizontal bottom wall 60 that rests upon a horizontal flat support surface 62 such as a floor or the ground. Container member 56 also includes an upright side wall 64 formed in a piece at its bottom rim portion 66 with bottom wall 60. Bottom wall 60 and side wall 64 define a generally cylindrical compartment 68 adapted to contain edible substances such as garbage that would be an attraction for wild animals. Compartment 68 has a substantially horizontal open face defined by circular top rims portion 70 of circular side wall 64. The outer surface 72 of side wall 64 forms an external thread portion 74 that extends downwardly from top rim portion 70. Thread portion 74 will be discussed further below.

FIGS. 4 and 5 also illustrate a circular top wall 76 and a short circular edge wall 78 formed in a piece with the circular edge portion 80 of top wall 76. Circular edge wall 78 has a circular bottom rim portion 82. Edge wall 78 depends vertically from circular edge portion 80. The inner surface 83 of edge wall 78 forms an internal thread portion 84 between top edge portion 80 and bottom rim portion 82 that is adapted to mate with external thread portion 74 of container member 56. FIG. 5 indicates three fully circumferential mating threads of external and internal thread portions 74 and 84. It is noted that at least one full set of mating threads should be formed, and alternatively, two, three, or more full mating threads be formed. When internal thread portion 84 of lid member 58 has been threaded onto external thread portion 74 of container member 56, edge wall 78 of lid member 58 fits closely around side wall 64, lid member 58 and container member 56 have been disengageably connected, and compartment 68 has been made secure against entry by animals.

As also can be seen in FIGS. 4 and 5, three hand grips 86, 86' and 86'' extend upwardly from top wall 76 at circular edge portion 80 directly above edge wall 78. Hand grips 86, 86' and 86'' are integral with lid member 58. Each hand grip 86, 86' and 86'' is each an elongated cylindrical handle of the same plastic material as lid member 58 that extends substantially vertically to a distance that allows a good hand grip for a user. The diameter of each hand grip 86, 86', and 86'' likewise is such that it gives a user a good hand grip. Hand grips 86, 86' and 86'' are circumferentially spaced at substantially equal angular intervals around edge portion 80. In particular as shown in FIG. 4, the angular intervals are approximately 120°. This angular spacing allows a user to utilize both hands to screw or unscrew lid member 58 onto or from container member 56 without stretching.

As also can be seen in FIGS. 4 and 5, three hold down flange members 88, 88', and 88'' are integrally connected to outer surface 72 of side wall 64 of container member 56 at bottom wall 66. Each hold down flange member 88, 88', and 88'' extends radially outwardly from side wall 64. the bottom surface 92 of each flange member is flat and positioned against support surface 62. Bottom surface 92 is disposed below the plane of bottom wall 108 so that bottom wall 108 is slightly spaced from support surface 62. Each flange member preferably has a downward flat downwardly sloped top surface 94 that is spaced slightly above bottom surface 92 and is approximately adjacent to support surface 62 at the outer extremity of each flange member spaced from side wall 64. Flange members 88, 88' and 88'' are circumferentially spaced about side wall 64 at substantially equal angular intervals. In the embodiment shown in FIGS. 4 and 5, flange members 88, 88' and 88'' are spaced at approximately 120° intervals. Hold down flange members 88, 88' and 88'' provide a foot press for a user to keep container member 56 stationary against support surface 62 while lid member 58 is being screwed onto or from the container member.

Hold down flange members 90, 90' and 90'' may be turned inwardly into compartment 68 at bottom wall 16 as an alternate form of accomplishing the hold down function of the flange members. In such an embodiment, recesses would be formed in the side wall 64 to accommodate the foot of the user.

Figure 7:
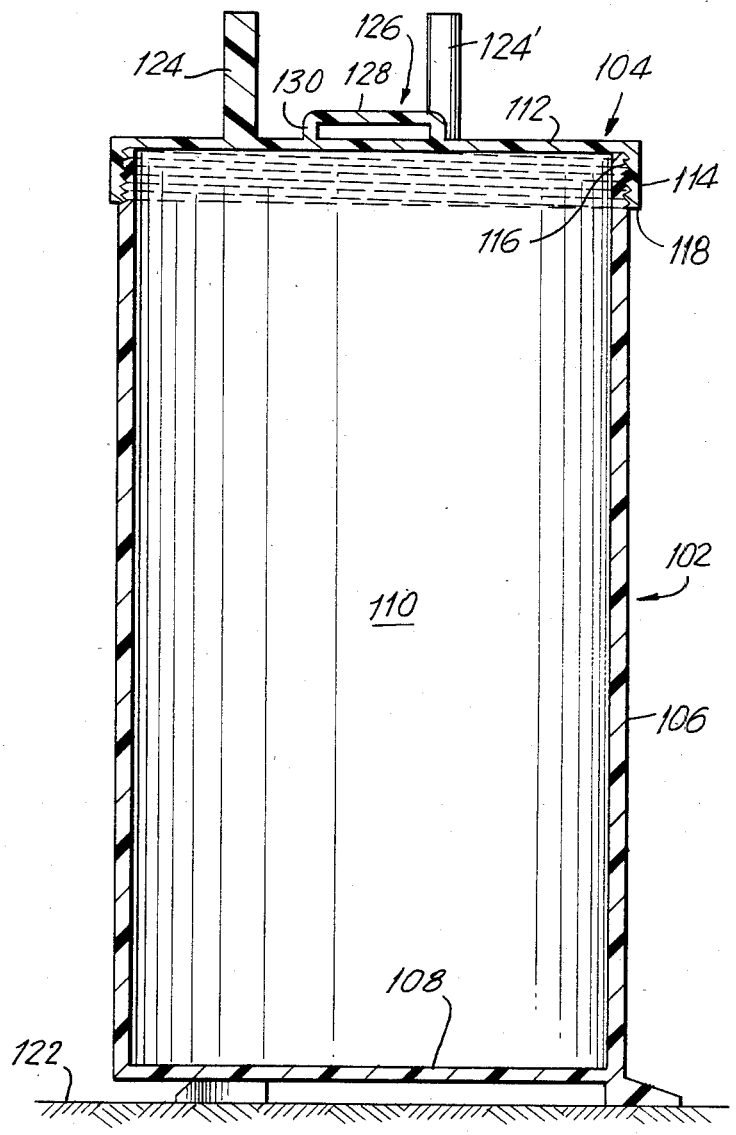
FIG. 7 is a sectional view taken through line 7—7 of FIG. 6.

Another embodiment of the present invention is shown in FIGS. 6 and 7. A storage container apparatus 100 made of substantially rigid plastic as is storage container apparatus 54 described in relation to FIGS. 5 and 6. Apparatus 100 includes a cylindrical container member 102 and a cylindrical lid member 104 capable of being threaded onto container member 102 in the same manner as described with relation to apparatus 54. In particular, container member 102 includes a cylindrical side wall 106 and a circular bottom wall defining a substantially cylindrical compartment 110 having an open top. Lid member 104 includes a circular top wall 112 and a cylindrical edge wall 114 depending from the circular edge of top wall 112. The outer surface of side wall 106 forms an external thread portion 116 below the upper rim of side wall 106; and the inner surface of edge wall 114 of lid member 104 forms an internal thread portion 118 that is capable of being threaded onto external thread portion 116, a disposition shown in FIGS. 7 and 8. Preferably, three hold down flange members 120, 120' and 120'' are disposed at equal angular intervals around the outer surface of side wall 106 of container member 102, namely, at 120° intervals in the particular embodiment shown. The hold down flange members rest upon a support surface 122 so that bottom wall 108 is slightly spaced from the support surface. In this embodiment, three hand grips 124, 124' and 124'' are disposed in a circular pattern at the top surface of top wall 112 of lid member 104. The circular pattern is concentric with the axial center of lid member 104 and spaced inwardly from the edge portion of top wall 112. Each hand grip 124, 124' and 124'' is cylindrical and extends vertically upwardly from top wall 112 to a distance that allows a user to hold the hand grips. The diameter of the cylindrical hand grips likewise is such that a user finds it easy to hold the grips. Hand grips 124, 124' and 124'' are integral with top wall 112. The radial distance between the center of top wall 112 and the circular pattern mentioned earlier can vary, but it is to be pointed out that the greater the radial distance the hand grips are from the center of the top wall 112, the greater is the leverage of the lid containeer during screwing operations, and that the less the radial distance the hand grips are from the center of top wall 112, the less is the leverage. In addition, a handle member 126 preferably formed integrally with top wall 112 is disposed at the center of top wall 112. Handle member 126 is slightly elongated and has a horizontal cross grip 128 generally paralled with and spaced from top wall 112 and a part of connecting upright end posts 130 and 130' that are integral both with top wall 112 and cross grip 128.

The embodiment of this invention particularly disclosed and described hereinabove is presented merely as an example of the invention. Other embodiments, forms, and modifications of the invention coming within the proper scope and spirit of the appended claims will, of course, readily suggest themselves to those skilled in the art. For example, the embodiments shown and described set forth an internal lid member, internal thread adapted to be threaded onto a container member external thread. Within the spirit and scope of the invention, however, the container member can for an internal thread portion formed in the inner surface of the container member and an external thread portion formed on the side wall of the lid member, so that the lid member may be set within the inner surface of the container member and screwed onto the internal threads of the container member.

It should also be appreciated that with the present invention, an extremely tight connection is achieved between the threaded means of the lid and container. As a result thereof, insects, bugs and other pests are precluded from being attracted to the container. Also, as any malodorous odors can also be kept sealed in the container, the garbage pail or storage container can be kept indoors, such as in a garage, until it is time for collection. In this regard, as daily sanitation collection no longer exists and as municipalities are constantly cutting down services to two or three collections a week, the present apparatus is very desirable as it provides a tight seal almost equivalent to that type of a seal provided by a conventional Mason jar. Furthermore, a homeowneer need only have one container of the invention and could cull his refuse so that all perishable materials can be disposed of in the storage container of the present invention, while other more conventional garbage cans could be used for other non-perishable refuse, such as newspapers, wrappings, empty bottles and cartons, etc.

It is also to be mentioned that the hand grips for each of the lids of the various embodiments described that are held by a person in the process of threading or unthreading the lid member onto or from the container member can be used without the aid of the foot hold down flanges since the support surface would be expected to frictionally cooperate with the container member in association with the bottom wall in most cases so as to provide resistance to turning during the process of threading and unthreading.

What is claimed is:

1. An animal proof storage container apparatus comprising, in combination:

a substantially rigid cylindrical container member having a circular bottom wall resting upon a support surface and having an upright generally circular side wall thus defining a substantially enclosed storage compartment, said side wall having a circular top rim portion and externally disposed thread means at an upper edge of said top rim portion, a substantially rigid lid member having a circular top wall and having a downwardly directed flange; and said lid member having internally disposed thread means on said downwardly directed flange, said lid member thread means container member thread means comprising substantially one complete revolution and being for removably connecting said lid member and said container member in threaded relationship, gripping means including a plurality of handles extending upwardly from said lid member and being generally peripherally disposed adjacent said flange of said lid member, wherein said handles are circumferentially spaced for providing hand holds for a user in the process of threading or unthreading said lid member onto or from said top rim portion of said container member, said support surface frictionally cooperating with said container member in association with said bottom wall to provide resistance to turning during the threading and unthreading process, and hold down means connected to said outer surface of said container member, enabling a user to employ at least one foot against said hold down means so as to keep said container member stationary against said support surface while said lid member is being screwed onto or from said container member; whereby animals are precluded from separating the threaded relationship of said lid member and said container member.

2. A storage container according to claim 1, wherein said hold down means is connected to said outer surface of said container member at said bottom wall.

3. A storage container according to claim 2, wherein said gripping means are substantially cylindrical handles extending upwardly from an external edge portion of said downwardly directed flange of said lid member.

4. A storage container according to claim 3, wherein said handles are three circumferentially spaced at approximately 120° intervals.

5. A storage container according to claim 1, wherein said hold down means includes a plurality of flange members extending outwardly from said side wall of said container member at said bottom wall, said plurality of flanges being adapted to rest against said support surface.

6. A storage container according to claim 5, wherein said plurality of flange members are circumferentially spaced at substantially equal angular intervals around said side wall of said container member.

7. A storage container according to claim 6, wherein said plurality of flange members includes three flange members spaced at substantially 120° intervals around said side wall.

8. A storage container according to claim 1, further including an additional loop-type handle member disposed over the center of said circular top wall.

9. A storage container according to claim 8, wherein said lid member and said container member are made of metal, said lid member further including means for securing said handles to said lid member, and said container member further including means for securing said flange members to said container member.

10. A storage container according to claim 8, wherein said lid member and said container member are made of plastic material, said handles being integral with said lid member, and said flange members being integral with said container member.

11. A storage container according to claim 1, wherein said internally disposed thread portion of said externally disposed thread portion together form at least one full mating thread for forming the complete revolution.

12. A storage container according to claim 11, wherein said at least one full mating thread is a plurality of full mating threads.

* * * * *